US009551256B2

(12) United States Patent
Wickham

(10) Patent No.: US 9,551,256 B2
(45) Date of Patent: Jan. 24, 2017

(54) HEAT EXCHANGE UNIT

(71) Applicant: Heat Recovery Solutions Limited, London (GB)

(72) Inventor: Mark Wickham, London (GB)

(73) Assignee: Heat Recovery Solutions Limited, London (GB)

( * ) Notice: Subject to any disclaimer, the term of this patent is extended or adjusted under 35 U.S.C. 154(b) by 0 days.

(21) Appl. No.: 14/831,060

(22) Filed: Aug. 20, 2015

(65) Prior Publication Data

US 2015/0361856 A1 Dec. 17, 2015

Related U.S. Application Data

(62) Division of application No. 13/699,523, filed as application No. PCT/GB2011/050991 on May 26, 2011, now Pat. No. 9,127,580.

(30) Foreign Application Priority Data

May 26, 2010 (GB) ..... 1008806.0

(51) Int. Cl.

| | |
|---|---|
| ***F22B 1/18*** | (2006.01) |
| ***F01N 5/02*** | (2006.01) |
| ***F28D 7/02*** | (2006.01) |
| *F28D 21/00* | (2006.01) |

(52) U.S. Cl.

CPC ..... *F01N 5/02* (2013.01); *F28D 7/024* (2013.01); *F28D 21/0003* (2013.01)

(58) Field of Classification Search

CPC ..... F22B 1/18; F22B 1/1807; F22B 1/1815; F28D 21/0003; F28D 21/001; F28D 7/024; F24F 7/04; F24F 3/16; F01N 5/02

USPC 122/7 R, 7 B, 32, 33, 367.1, DIG. 3; 165/8, 165/9, 10, 12, 66, 177–179, 181–183

See application file for complete search history.

(56) References Cited

U.S. PATENT DOCUMENTS

| | | | | |
|---|---|---|---|---|
| 2,091,119 A | | 8/1937 | Saint-Jacques | |
| 3,295,503 A | * | 1/1967 | Ranebo | F22D 1/16 122/20 B |
| 3,302,705 A | * | 2/1967 | Witten, Jr. | F24H 1/403 122/235.11 |

(Continued)

FOREIGN PATENT DOCUMENTS

| | | |
|---|---|---|
| BE | 891799 A1 | 7/1982 |
| EP | 0351247 A2 | 1/1990 |

(Continued)

OTHER PUBLICATIONS

Office Action issued under EP Application No. 11729653.3 dated Oct. 14, 2015.

(Continued)

*Primary Examiner* — Gregory A Wilson

(74) *Attorney, Agent, or Firm* — Fox Rothschild LLP

(57) ABSTRACT

A heat exchange unit (214) arranged to be used to recover energy from exhaust gas, the heat exchange unit (214) comprising a gas inlet duct (222) to which a heat exchange duct (216) is connected, wherein a heat exchange array (752, 754) of a heat exchange system is situated within the heat exchange duct (216) surrounding a maintenance duct and wherein the maintenance duct (226) is arranged to allow access for inspection and/or maintenance of at least part of the heat exchange system.

16 Claims, 8 Drawing Sheets

(56) References Cited

U.S. PATENT DOCUMENTS

| | | | | | |
|---|---|---|---|---|---|
| 3,372,677 | A * | 3/1968 | Boyen | F01K 23/101 | 122/249 |
| 3,647,357 | A * | 3/1972 | Niedner | B01F 5/0068 | 423/512.1 |
| 3,975,229 | A * | 8/1976 | Jackson | B01D 3/00 | 122/7 R |
| 4,113,009 | A * | 9/1978 | Meyer | F23L 15/04 | 110/326 |
| 4,327,801 | A * | 5/1982 | Koizumi | F04D 29/582 | 165/104.21 |
| 4,398,452 | A | 8/1983 | Bradshaw | | |
| 4,446,820 | A | 5/1984 | Jansing et al. | | |
| 5,069,169 | A * | 12/1991 | Maruko | F22B 23/04 | 122/33 |
| 5,881,681 | A * | 3/1999 | Stuart | F23D 14/24 | 122/18.31 |
| 6,340,002 | B1 * | 1/2002 | Liebig | B01D 53/8631 | 122/4 D |
| 7,275,503 | B2 * | 10/2007 | Waseda | F28F 9/013 | 122/510 |
| 7,891,324 | B2 * | 2/2011 | Franklin | F28C 1/14 | 122/31.1 |
| 8,220,274 | B2 * | 7/2012 | Bono | B01D 53/343 | 122/7 R |
| 9,080,816 | B2 * | 7/2015 | Wickham | F28D 7/106 | |
| 9,145,813 | B2 * | 9/2015 | An | F01N 5/025 | |
| 2005/0115242 | A1 * | 6/2005 | Conrad | F02G 1/0435 | 60/714 |
| 2005/0133202 | A1 * | 6/2005 | Jorgensen | F28D 7/024 | 165/103 |

FOREIGN PATENT DOCUMENTS

| | | |
|---|---|---|
| EP | 2072938 A2 | 6/2009 |
| FR | 2574176 A1 | 6/1986 |

OTHER PUBLICATIONS

Office Action issued for Australia Patent Application No. 2011256963 dated Feb. 5, 2016.

Translation of Office Action issued for Mexican Application No. MX/A/2012/013632 dated Oct. 15, 2015.

Chinese Office Action issued Nov. 14, 2014 for CN Application No. 2011800367299.

* cited by examiner

HEAT EXCHANGE UNIT

CROSS-REFERENCE TO RELATED APPLICATION

This application is a Divisional of U.S. patent application Ser. No. 13/699,523, filed Feb. 8, 2013, which is the U.S. National Phase Application of International Application No. PCT/GB2011/050991, filed May 26, 2011, which claims priority to GB Application No. 1008806.0, filed May 26, 2010. The disclosures of all applications are incorporated herein by reference.

FIELD OF INVENTION

The present invention relates to a heat exchange unit arranged to recover energy from exhaust gas and a method of re-fitting a process heat source unit exemplified by a simple cycle gas turbine, so as to convert it to combined cycle. In particular, but not exclusively, the invention relates to a heat exchange unit associated with a power plant, which is typically a gas turbine and/or gas/diesel engine or the like, arranged to extract heat from the exhaust gas.

BACKGROUND OF INVENTION

Heat exchangers used to recover heat from such power plant exhaust gas are often somewhat large and cumbersome in design. Consequently they are often designed to be transported in component form and assembled on site. Additionally they are not optimized efficiently for space and straightforward connection to the gas turbine or gas/diesel engine. These design limitations lead to the requirement for additional floor-space and increased transportation, assembly, testing and maintenance costs. These difficulties sometimes lead to operators opting for simple cycle (no heat recovery), which is considerably less efficient than a combined cycle and in which hot exhaust gas is vented straight to atmosphere. Historically simple cycle power plants may have been installed when there were fewer environmental concerns and fuel consumption was not critical.

Further problems are also recognized in the industry. Irregular flow distribution in power plant exhaust gas delivered to the heat exchanger (for example a velocity of 120 m/s forward flow to a backflow of 20 m/s in the same duct) can cause damage to heat exchange tubes, linings, dampers, burners and other plant equipment. Damage may be caused by excessive vibration, oscillations, or the like. The standard remedy has been to provide longer ducts with increased cross sectional area to allow the higher velocities to reduce naturally over distance. Again however this results in inefficient use of space and increased costs. Alternatively the components may be made significantly stronger and more durable, but this requires more expensive materials and manufacturing and increases weight.

It is sometimes desirable for heat exchangers to convert extra heat energy, when compared to the amount of heat present in the exhaust leaving the power plant, in order to increase the output of the heat exchange process. In presently used systems this is often achieved by a duct burner, which heats the hot exhaust gases further after they have left the power plant and before they enter the heat exchanger. The amount of extra output that can be gained in this way is however limited; the exhaust gases are already at a relatively high temperature which may be close to the maximum temperature tolerance of the heat exchanger, linings and internal components.

According to a first aspect of the invention there is provided a heat exchange unit arranged to be used to recover energy from exhaust gas. The heat exchange unit generally comprises a gas inlet duct to which a heat exchange duct is connected. A heat exchange array of a heat exchange system may be situated within the heat exchange duct and may surround a maintenance duct. The maintenance duct may be arranged to allow access for inspection and/or maintenance of at least part of the heat exchange system.

The maintenance duct may conveniently replace a by-pass duct where this is not required (for example where the heat exchange unit is a steam generator). The maintenance duct may allow for maintenance and/or inspection to be carried out on the heat exchange system in a controlled environment, without the need for the heat exchange unit to be located within a building. The maintenance duct may be sized in order to allow man access thereto; for example it may be sized to allow a man to enter the maintenance duct and inspect the inside thereof.

According to a second aspect of the invention there is provided a heat exchange unit arranged to be used to recover energy from exhaust gas. The heat exchange unit may comprise an inlet duct to which a heat exchange duct is connected. A heat exchange array may be situated within the heat exchange duct and the inlet duct and heat exchange duct may have substantially perpendicular longitudinal axes so as in use gas is delivered to the heat exchange duct in a direction substantially perpendicular to the longitudinal axis of the heat exchange duct.

If the inlet duct and heat exchange duct have substantially perpendicular longitudinal axes so as in use gas is delivered to the heat exchange duct in a direction substantially perpendicular to the longitudinal axis of the heat exchange duct, advantages over alternative systems may be evident. In some current systems at least part of an inlet duct is provided with a significant curve to allow connection to an end of a heat exchange duct which is substantially perpendicular to the remaining part of the inlet duct. The present system may be more straightforward than this prior art system and may allow for easier and closer connection between the source of the exhaust gas and the heat exchange duct.

According to a third aspect of the invention there is provided a heat exchange unit arranged to be used to recover energy from exhaust gas. The heat exchange unit may comprise an inlet duct to which a heat exchange duct is connected. At least two heat exchange arrays may be situated within the heat exchange duct and between the at least two heat exchange arrays is a heating mechanism.

The heating mechanism may be a burner or electrical elements for example.

Such an arrangement may allow for enhanced heat conversion. This may be particularly useful where an increase in the heat conversion may be required despite a potential loss in efficiency arising from the consumption of additional fuel in the heating mechanism.

It will be appreciated that any one of the first, second and third aspects may be combined with one or both of the other aspects. With this in mind the following embodiments may be combined with one or more of the aspects described above, where the features discussed in said embodiments are also present in said aspect or combination of aspects.

Where a maintenance duct is provided it may be substantially cylindrical. In view of the heat exchange array, this may provide a space-efficient solution whereby the maintenance duct provides enough room for access, but does not necessitate an unnecessary increase in the size of the heat exchange unit.

In some embodiments the heat exchange duct and maintenance duct are substantially coaxial. Again this may provide a space efficient solution whereby the heat exchange duct and heat exchange array necessitate only the minimum required increase in the size of the heat exchange unit.

In some embodiments pipes and headers for supply to and/or exit from the heat exchange array are provided in the maintenance duct.

In some embodiments the maintenance duct provides access to the pipes and headers for their inspection and maintenance. In this way inspection and maintenance can be carried out in a controlled environment (e.g. without inclement weather hampering the work). Additionally the maintenance duct may mean that access to the pipes and headers is significantly improved.

In some embodiments the maintenance duct is provided with a vertical access means for passing substantially the full height of the maintenance duct. Thus a ladder or lift for example may be provided inside the maintenance duct to assist with inspection and/or maintenance.

In some embodiments the maintenance duct provides structural support for the heat exchange unit. This may reduce or eliminate the structural load placed on the heat exchange duct, which may facilitate flexibility with regard to materials used and the design of the heat exchange unit as a whole.

In some embodiments the maintenance duct acts as a deflector for gas entering via the gas inlet duct, so as to alter the gas flow distribution. This may help to improve gas flow distribution.

In some embodiments the gas inlet duct is provided with at least one duct burner. This may allow for enhanced heat conversion in the heat exchange unit.

In some embodiments the gas inlet duct is positioned so as to introduce the gas tangentially to a portion of the interior perimeter of the heat exchange duct. This may improve flow distribution and reduce back pressure. Specifically tangential gas entry may create high speed circulating gas currents which dissipate their kinetic energy in a controlled manner, before moving through the heat exchange duct.

In other embodiments the gas inlet duct is positioned so as to introduce the gas so that the gas impinges upon a splitter within the gas inlet duct. A portion of the maintenance duct may provide the splitter.

In some embodiments first and second heat exchange arrays and the heating mechanism are positioned so as exhaust gas falls to a temperature between 250° C. and 350° C. before reaching the heating mechanism. In some embodiments the two heat exchange arrays and the heating mechanism are positioned so as exhaust gas falls to a temperature of approximately 300° C. before reaching the heating mechanism.

Such arrangements may provide an efficient system. A large quantity of the thermal energy carried by the gas entering via the exhaust gas inlet duct is recovered by the first heat exchange array. Following this, at the temperatures discussed, the gas may still be sufficiently hot (with the given oxygen content in the gas) to allow combustion in the heating mechanism. The heating mechanism may then reheat the gas to proximate the maximum safe temperature tolerance of the heat exchange unit, linings and internals, whereupon the second heat array recovers the thermal energy from the re-heated gas. The first heat exchange array may also help remove turbulent flow from the exhaust gas in order that the flow is more regular when it reaches the or each heating mechanism. The skilled person will appreciate that turbulent flow can cause problems with such heating mechanisms and potentially extinguish flames therefrom.

In some embodiments the heating mechanism raises the temperature of the exhaust gas to between 700° C. and 800° C. In some embodiments the heating mechanism raises the temperature of the exhaust gas to approximately 760° C. These temperatures may be proximal to the maximum temperature tolerance of materials such as stainless steel which may be used in the heat exchange unit.

In some embodiments the heating mechanism is a ring burner. In view of its shape a ring burner may be particularly appropriate where the heat exchange duct is cylindrical (has a circular cross-section).

In some embodiments the gas inlet duct is not provided with a burner. This may allow for the gas inlet duct to be shorter, thus potentially decreasing the distance between the source of the exhaust gas and the heat exchange unit, making the whole system more space efficient.

In some embodiments the heat exchange array(s) is helical. Such a shape is convenient since it allows for a compact run of tubes. However, other forms of array may equally be possible.

In Some Embodiments the Exhaust Gas is Produced by a Gas Turbine.

In some embodiments the heat exchange unit is a once through steam generator. As will be appreciated embodiments of the present invention may provide a space efficient solution to heat recovery. Use with a once through steam generator (also a space efficient technology) may therefore be advantageous in order that the overall system has a small footprint.

In some embodiments the heat exchange unit is substantially weather proof. This may be advantageous as it may not then be necessary to house the heat exchange unit within a building. Additionally this may make inspection and maintenance of the heat exchange unit easier and safer.

In some embodiments the heat exchange unit is roughly between 2.6 m and 8 m in diameter.

In some embodiments the heat exchange duct is substantially cylindrical. This may be especially suitable in view of the use, in some embodiments, of one or more helical heat exchange arrays, and may provide a space efficient solution.

In some embodiments, when installed, the heat exchange duct is arranged substantially vertically. This may make the heat exchange duct (and heat exchange unit in general) more suitable for replacing any existing exhaust stack. Additionally it may reduce the footprint of the heat exchange duct.

According to a forth aspect of the invention there is provided a method of re-fitting a process heat source unit (exemplified by a simple cycle gas turbine), so as to convert it to combined cycle, the method comprising the steps of:

1) providing a heat exchange unit arranged to recover energy from exhaust gas, the heat exchange unit comprising an inlet duct to which a heat exchange duct is connected, wherein a heat exchange array is situated within the heat exchange duct;

2) delivering the heat exchange unit, which is generally pre-assembled and tested, to the location of the process heat source unit; and 3) replacing an existing exhaust stack of the process heat source unit with the heat exchange unit.

In some embodiments the process heat source unit is a gas turbine.

In some embodiments foundations used for supporting the existing exhaust stack are used to support the heat exchange unit. This may reduce costs and the time necessary for conversion.

In some embodiments the inlet duct and heat exchange duct have substantially perpendicular longitudinal axes so as in use gas is delivered to the heat exchange duct in a direction substantially perpendicular to the longitudinal axis of the heat exchange duct This may reduce the height of the heat exchange duct. It may also reduce the time necessary for conversion as a perpendicular inlet duct may be less complicated and more easily structurally supported than for example a co-axial inlet duct.

The method may utilise a heat exchange unit according to any of the above aspects of the invention.

BRIEF DESCRIPTION OF THE FIGURES

Embodiments of the invention will now be described, by way of example only, with reference to the figures in which:—

DETAILED DESCRIPTION OF INVENTION

Figure 1:
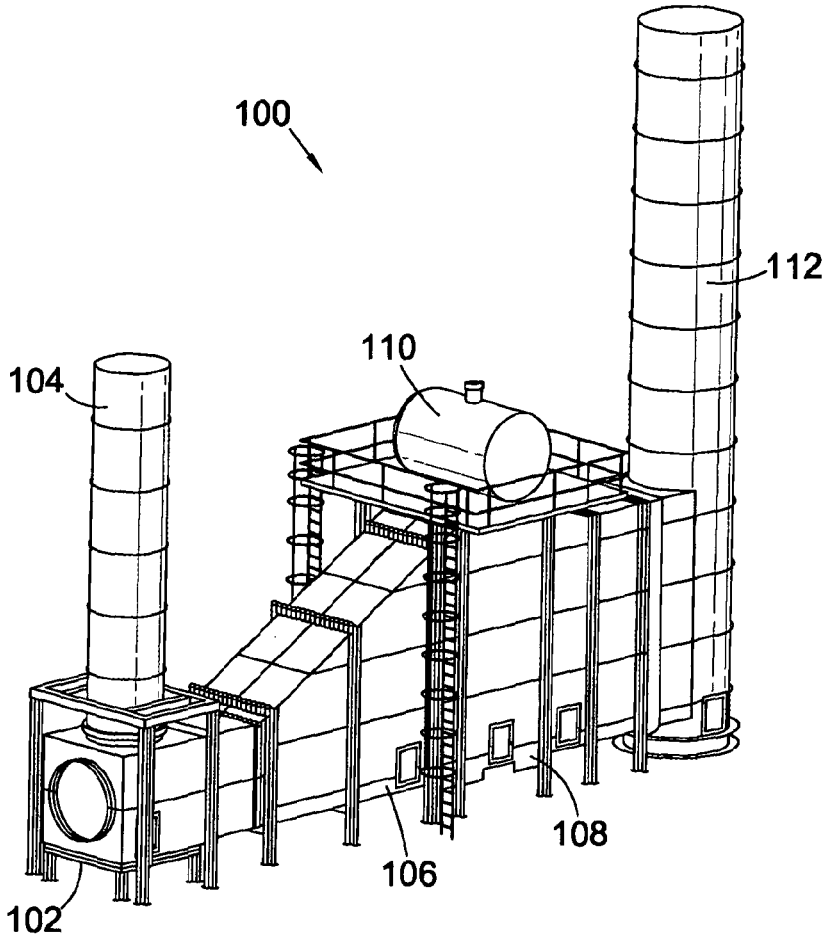
Fig. 1 (PRIOR ART)
FIG. 1 is a perspective view of a prior art heat exchange unit.

Referring first to FIG. 1, a prior art heat exchanger unit is generally provided at 100. The heat exchanger unit 100 is for heat recovery from the exhaust gases of a gas turbine (not shown). The heat recovered is used to produce high pressure steam to drive an electricity generating steam turbine (not shown).

The heat exchanger unit 100 has an exhaust gas inlet 102. The exhaust gas inlet is supplied with exhaust gas from a gas turbine (not shown) but other embodiments may use any other type of power or process plant exhaust gas. From time to time the heat exchanger unit 100 is non-operative or else too much exhaust gas is being produced for the heat exchange unit 100 to process. On these occasions a diverter valve (not shown) is operable to divert some or all of the exhaust gas entering the exhaust gas inlet 102, into an exhaust gas bypass 104. When however the heat exchange unit 100 is operative, the exhaust gas is allowed, by the diverter valve, to continue past the exhaust gas bypass 104, whereupon it passes a duct burner (not shown). The duct burner may be used to heat the exhaust gas so as to enhance heat conversion later in the process. Beyond the duct burner is a flame development chamber 106 where the exhaust gas is heated. The flame development chamber 106 feeds a heat exchange chamber 108, which houses an array of tubular heat exchange pipes (not shown). Water is circulated in the heat exchange pipes (forming a heat exchange array), and heat recovered from the exhaust gas by water evaporation in the heat exchange pipes to form steam. Steam is collected in a steam drum 110 for use in powering a steam turbine. Finally the exhaust gas passes up an exhaust stack 112 to be released. Typically, the heat exchange array is connected to a heat exchange system arranged to pass fluid through the heat exchange pipes. Generally, the heat exchange system will largely be provided outside of the heat exchange unit.

It will be appreciated that the heat exchanger unit 100 may be a large device. This may necessitate extensive site assembly works and foundations. In view of the large size of the device, modular transportation may be a requirement of the design. A large building may also be required in order that inspection and maintenance can be performed without prevailing weather conditions making this difficult and/or dangerous.

In some prior art systems, especially where a heat exchanger unit 100 or similar would be too large or expensive, a heat exchanger is omitted altogether. Where there is no heat exchanger (i.e. the exhaust gas is vented to atmosphere) the process is described as simple cycle. This may be relatively inefficient and environmentally damaging (in contrast to a combined cycle where exhaust gases are processed for heat recovery). In a simple cycle process the exhaust gas is usually passed straight into an exhaust stack thereby wasting all of the heat energy which is stored in that gas.

Embodiments of the present invention may offer advantages over systems such as the heat exchanger unit 100. Additionally embodiments of the present invention may be particularly suitable for use in replacing a pre-existing exhaust stack in a simple cycle process so as to create a combined cycle process.

It should be understood that although embodiments of the present invention are described for convenience as processing hot exhaust gas from gas turbines, this is not intended to be limiting. Embodiments of the present invention might be used in heat recovery from other systems such as reciprocating engines and process furnaces or indeed any other type of power source.

It should also be understood that some embodiments of the invention are indicated to be suitable for production of steam to be used in energy generation, while other embodiments are indicated to be suitable for heating single phase process fluids such as oil or water to be used in heating applications. Despite this many of the features discussed are universal and the skilled person could readily adapt the teachings to be used in either technology.

Some embodiments features are particularly suited for use in steam generation systems and these features are identified as such.

Figure 2:
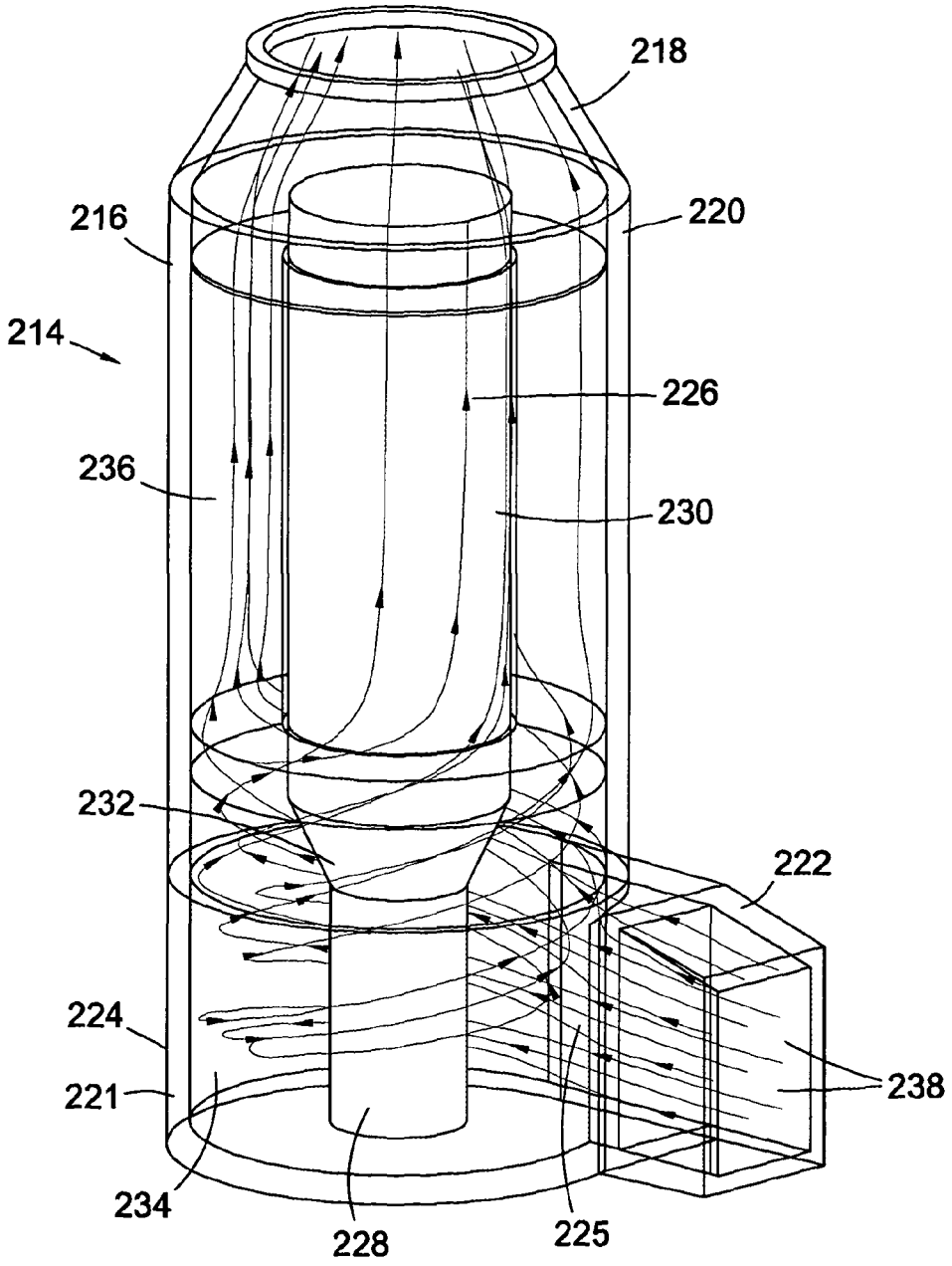
FIG. 2 is a cut-away perspective view showing an embodiment of the invention.

Referring now to FIG. 2, a heat exchange unit according to an embodiment of the invention is generally provided at 214. The heat exchange unit 214 has a cylindrical heat exchange duct 216. The heat exchange duct 216 is positioned substantially vertically and is provided with a cone frustum shaped terminus 218 at a distal end region 220 (the end region where exhaust gas exits the heat exchange duct) thereof. At a proximal end region 221 (the end region where exhaust gas enters the heat exchange duct) thereof, the cylindrical heat exchange duct 216 is provided with a gas inlet duct 222. The gas inlet duct 222 and heat exchange duct 216 have substantially perpendicular longitudinal axes and the inlet duct 222 is directly connected to the heat exchange duct 216 via an aperture 225 in a side wall 224 of the heat exchange duct 216. Additionally the gas inlet duct 222 is positioned so as to introduce the gas tangentially to a portion of the interior perimeter of the side wall 224.

Arranging the gas inlet duct 222 and heat exchange duct 216 perpendicularly and connecting the inlet duct 222 via aperture 225 as discussed above means that gas is delivered to the heat exchange duct 216 in a direction substantially perpendicular to the longitudinal axis of the heat exchange duct 216. It will be appreciated however that this may be achieved without the inlet duct 222 being directly connected to the heat exchange duct 216. It may be for example that a connector is used between the gas inlet duct 222 and the heat exchange duct 216, assuming that the connector does not substantially alter the direction of gas flow into the heat exchange duct 216. It may therefore extend the longitudinal length of the inlet duct 222, without necessarily having the same cross-sectional size and/or shape and without necessarily being coaxial with it. The skilled man will appreciate that function of the arrangement, regardless of myriad possible subtle differences, is to deliver gas to the heat exchange duct 216 in a direction substantially perpendicular to the longitudinal axis of the heat exchange duct 216. This may allow for the heat exchange unit 214 and its connection to a process heat source unit to be more compact and more easily installed, especially compared to systems where gas is delivered to a heat exchange duct parallel to its longitudinal axis.

Positioned within the heat exchange duct 216, and coaxial with it, is a maintenance duct 226. The maintenance duct 226 comprises proximal 228 and distal 230 cylindrical sections. The proximal cylindrical section 228 has a smaller diameter than the distal cylindrical section 230 and the two are joined by a cone frustum shaped intermediate section 232. The proximal cylindrical section 228 is provided with a door (not shown) for access to the maintenance duct 226 from below it. The maintenance duct 226 is also provided with an interior ladder (not shown) providing a vertical access means for passing substantially the full height of the maintenance duct 226.

The heat exchange duct 216 and proximal cylindrical section 228 of the maintenance duct 226 define a velocity dissipation chamber 234 between them. The heat exchange duct 216 and distal cylindrical section 230 define a heat exchange chamber 236 between them. Normally a heat exchange array, which is typically helical, would be positioned in the heat exchange chamber 236 surrounding the distal cylindrical section 230 of the maintenance duct 226, however this has been omitted for clarity in FIG. 2. The heat exchange array, in this embodiment, comprises a helically wound pipe. The supply and exit for the heat exchange array are located inside the maintenance duct 226. The heat exchange array and its supply exit and connections form part of a once through steam generator.

The FIG. 2 embodiment is particularly suitable for steam generation rather than the heating of process fluids. This is because the heat exchange unit 214 itself is not provided with an exhaust gas bypass (instead it has been replaced with the maintenance duct 226). Exhaust gas bypasses are usually not required for steam generation (where there is generally no need to limit the quantity of steam produced). A bypass is however more advantageous where process fluids are heated, so as the heating process can be controlled. It will be appreciated however that the present embodiment could be adapted for use with process fluids if a bypass was provided external to the heat exchange unit 214 and/or the maintenance duct were replaced with a bypass duct.

Figure 3:
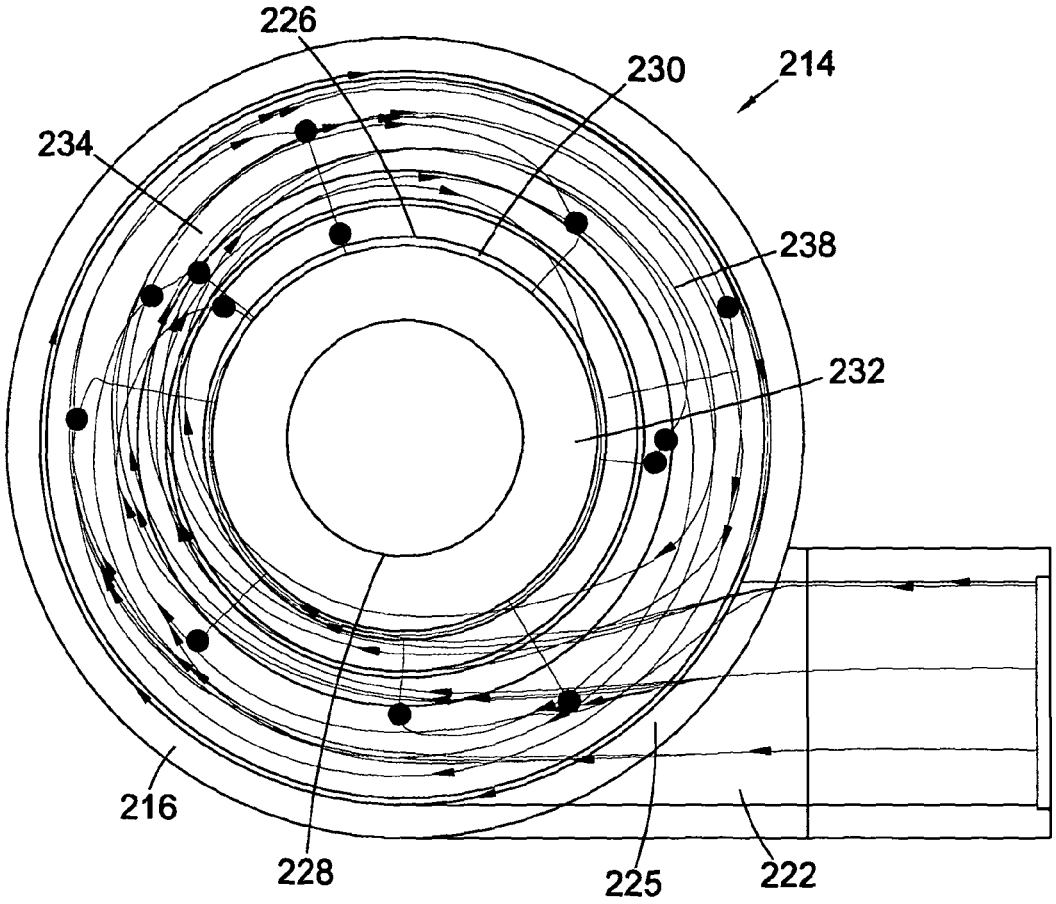
FIG. 3 is a plan view of an embodiment similar to that shown in FIG. 2.

With reference now to FIGS. 2 and 3, use of the embodiment in question is described. In use the heat exchange duct 216 is positioned substantially vertically. The gas inlet duct 222 is connected to the exhaust of a gas turbine (although it will be appreciated that other heat sources may be used) for the supply of exhaust gas to the heat exchange unit 214. Exhaust gas is therefore delivered to the velocity dissipation chamber 234 via the gas inlet duct 222. Because the gas inlet duct 222 is positioned so as to introduce the gas tangentially to a portion of the interior perimeter of the side wall 224, it creates a cyclone effect (as can be seen by the path of the exemplar exhaust gas currents 238), whereby higher velocity streams circulate circumferentially, guided by the walls of the proximal cylindrical section 228 and the heat exchange duct 216. In this way the velocity naturally dissipates and the previously higher velocity streams mix with slower streams, delivering a more uniform flow distribution to the heat exchange chamber 236 and heat exchange array. This reduces back pressure in the system and consequently increases efficiency. Additionally a more uniform flow distribution will reduce or eliminate damage that might otherwise be caused to the heat exchange unit 214. Finally the flow rate tolerances that must be designed into the heat exchange unit 214 may be reduced, potentially reducing design and manufacturing costs, dimensions and weight.

It will be appreciated that in other embodiments the exhaust need not be introduced tangentially to a portion of the interior perimeter of the side wall 224. Instead the introduction may simply be perpendicular to a longitudinal axis of the heat exchange duct. In this case the proximal cylindrical section 228 may act as a splitter, which (particularly where additional dissipation baffles are provided) may also improve gas flow distribution.

As the exhaust gas passes through the first coils of the heat exchange array its flow distribution further improves. Heat from the exhaust gas is then recovered by the heat exchange array (the water in its coils being converted to steam). Finally the exhaust gas leaves the heat exchange array 214 via the terminus 218.

Inspection and maintenance of the heat exchange array, supply and return to it and any headers provided, are made easier by the provision of the maintenance duct 226 and its ladder. Not only does the maintenance duct provide and improve access, but it also ensures that (regardless of whether or not the heat exchange unit 214 is located in a building) work can proceed without prevailing weather conditions hampering progress.

Figure 4:
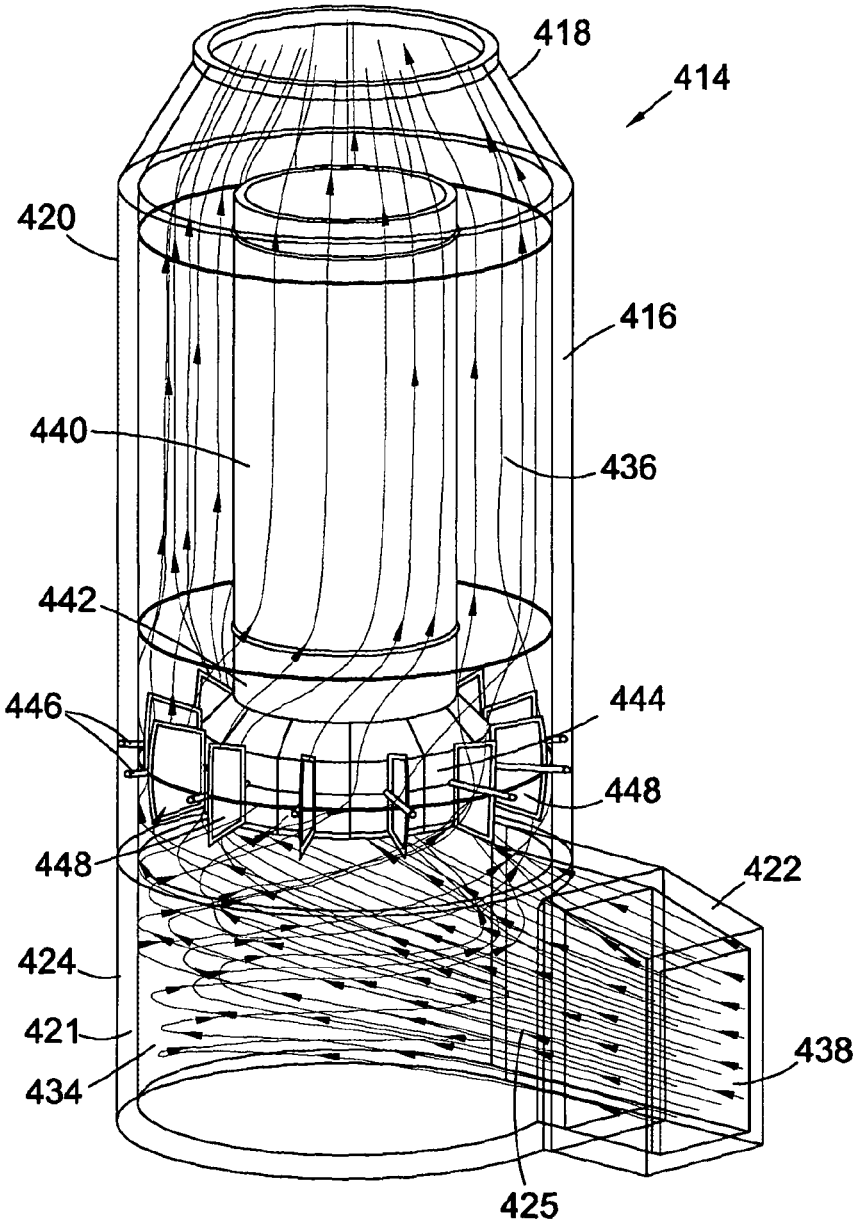
FIG. 4 is a cut-away perspective view of another embodiment of the invention.

Referring now to FIG. 4 similar features to those already discussed are given like reference numerals in the series 400. The heat exchange unit 414 shown in FIG. 4 is similar to that shown in FIG. 2. It possesses a cylindrical heat exchange duct 416. The heat exchange duct 416 is positioned substantially vertically and is provided with a cone frustum shaped terminus 418 at its distal end region 420 (the end region where exhaust gas exits the heat exchange duct) thereof. At a proximal end region 221 (the end region where exhaust gas enters the heat exchange duct) thereof, the cylindrical heat exchange duct 416 is provided with a gas inlet duct 422. At the point where the gas inlet duct 422 is connected to the heat exchange duct 416, it is substantially perpendicular to a longitudinal axis of the heat exchange duct 416. It therefore enters through the side wall 424 of the heat exchange duct 416. Additionally the gas inlet duct 422 is positioned so as to introduce the gas tangentially to a portion of the interior perimeter of the side wall 424.

Rather than a maintenance duct 226 being positioned within the heat exchange duct 416, a bypass duct 440 is provided coaxial with and inside the heat exchange duct 416. The bypass duct 440 is cylindrical in shape and is suspended by supports (not shown) above a velocity dissipation chamber 434 defined by the heat exchange duct 416 at its proximal end region 421. The heat exchange duct 416 and bypass duct 440 define a heat exchange chamber 436 between them.

Normally a heat exchange array, which is typically helical, would be positioned in the heat exchange chamber 436 surrounding the bypass duct 440, however this has been omitted for clarity in FIG. 4. The heat exchange array and its supply and return form part of a process fluid heating system.

At the base 442 of the bypass duct 440 is a diverter array 444. The diverter array 444 comprises a series of radially extending axles 446, extending at regular intervals from the centre of the diverter array 444 through the side wall 424. Each axle 446 is provided with a pair of vanes; heat exchange vane 448 and bypass vane 450 (see FIG. 6), each extending either side of the axle 446 and fixed at 90° to the other. The vanes 448, 450 on each axle 446 are arranged such that rotation of each axle 446 in one direction causes the heat exchange vanes 448 to overlap and shut-off the heat exchange chamber 436. Rotation in the other direction however causes the bypass vanes 450 to overlap and shut-off the bypass duct 440. It will be appreciated that in view of the 90° fixed angle between the vanes 448, 450, when the heat exchange chamber 436 is shut-off the bypass duct 440 is open and vice versa. Thus the diverter array 444 allows for full gas flow through the heat exchange chamber 436 or the bypass duct 440 or a split flow through both.

The skilled person will appreciate that a heat exchanger with diverter array and bypass duct of the type discussed here can be seen in UK Patent Application No: GB0822584.9, which is hereby incorporated by reference.

The FIG. 4 embodiment is particularly suitable for heating of process fluids because the heat exchange unit 414 is provided with the bypass duct 440. Therefore the heating process can be controlled. It will be appreciated however that the present embodiment could be used in a steam generating system where for the particular application it is desirable for there to be control over the quantity of steam generated.

Figure 5:
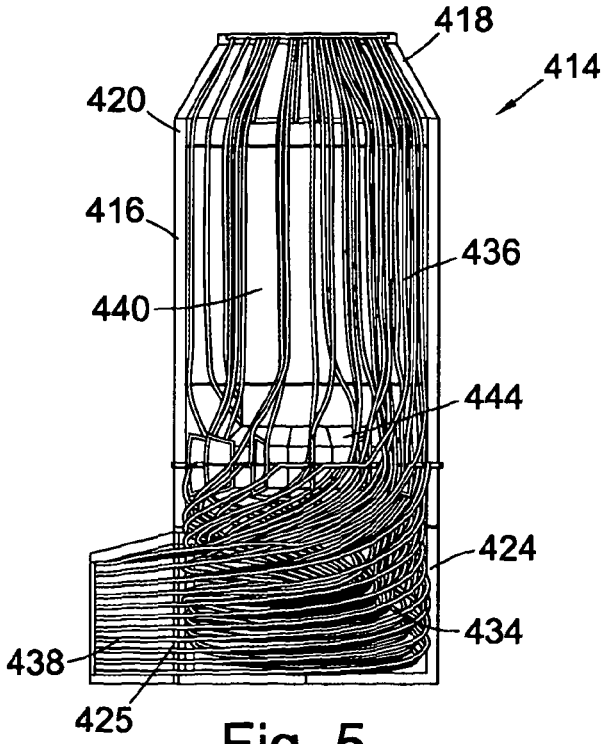
FIG. 5 is a cut-away side view of the embodiment of FIG. 4.
Figure 6:
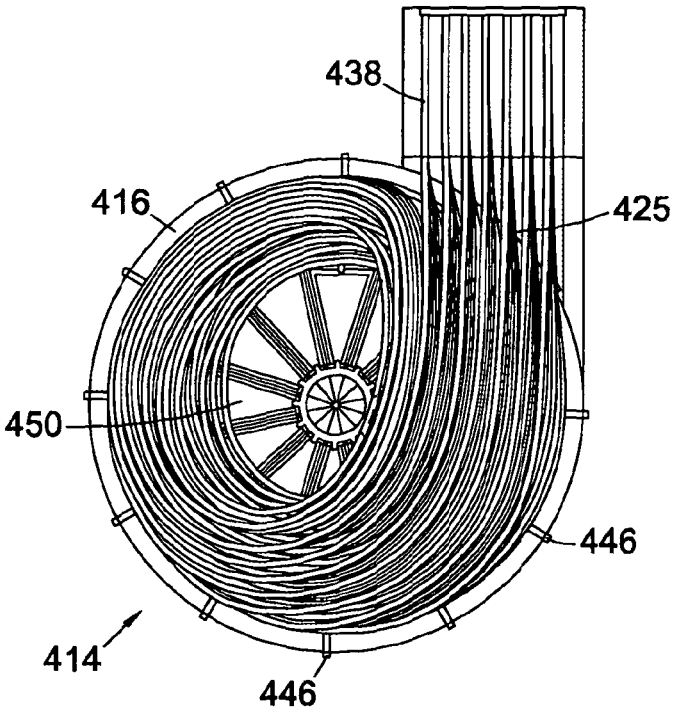
FIG. 6 is a plan view of an embodiment similar to that shown in FIGS. 4 and 5.

With reference now to FIGS. 4 to 6, use of the embodiment in question is described. In use, the heat exchange duct 416 is positioned substantially vertically. The gas inlet duct 422 is connected to the exhaust of a gas turbine (although it will be appreciated that other heat sources may be used) for the supply of exhaust gas to the heat exchange unit 414. Exhaust gas is therefore delivered to the velocity dissipation chamber 434 via the gas inlet duct 422 and an aperture 425 in the side wall 424. Because the gas inlet duct 422 is positioned so as to introduce the gas tangentially to a portion of the interior perimeter of the side wall 424, it creates a cyclone effect (as can be seen by the path of the exemplar exhaust gas currents 438), whereby higher velocity streams circulate circumferentially, guided by the side wall 424 of the heat exchange duct 416. In this way the velocity naturally dissipates and the previously higher velocity streams mix with slower streams, delivering a more uniform flow distribution to the heat exchange chamber 436 and heat exchange array and/or the bypass duct 440.

It will be appreciated that in other embodiments the exhaust need not be introduced tangentially to a portion of the interior perimeter of the side wall 424. Instead the introduction may simply be perpendicular to a longitudinal axis of the heat exchange duct. In this case dissipation baffles may be provided to improve gas flow distribution.

The diverter array 444 is controlled to determine whether the exhaust gas is passed through the heat exchange chamber 436 and heat exchange array (so as heating of the process fluid occurs) or through the bypass duct 440 (so as little or no process fluid heating occurs). It will be appreciated that the diverter array may also be controlled to allow variable percentages of the exhaust gas through both the heat exchange chamber 436 and the bypass duct 440.

Assuming that the diverter array 444 is controlled to allow at least some exhaust gas into the heat exchange chamber 436, its flow distribution further improves as it passes through the first coils of the heat exchange array. Heat from the exhaust gas is then recovered by the heat exchange array (process fluid in its coils being heated). Finally the exhaust gas leaves the heat exchange array 414 via the terminus 418. If the diverter array 444 is controlled to bypass at least some exhaust gas, this gas passes through the bypass duct 440 and leaves the heat exchange array 414 via the terminus 418.

Figure 7:
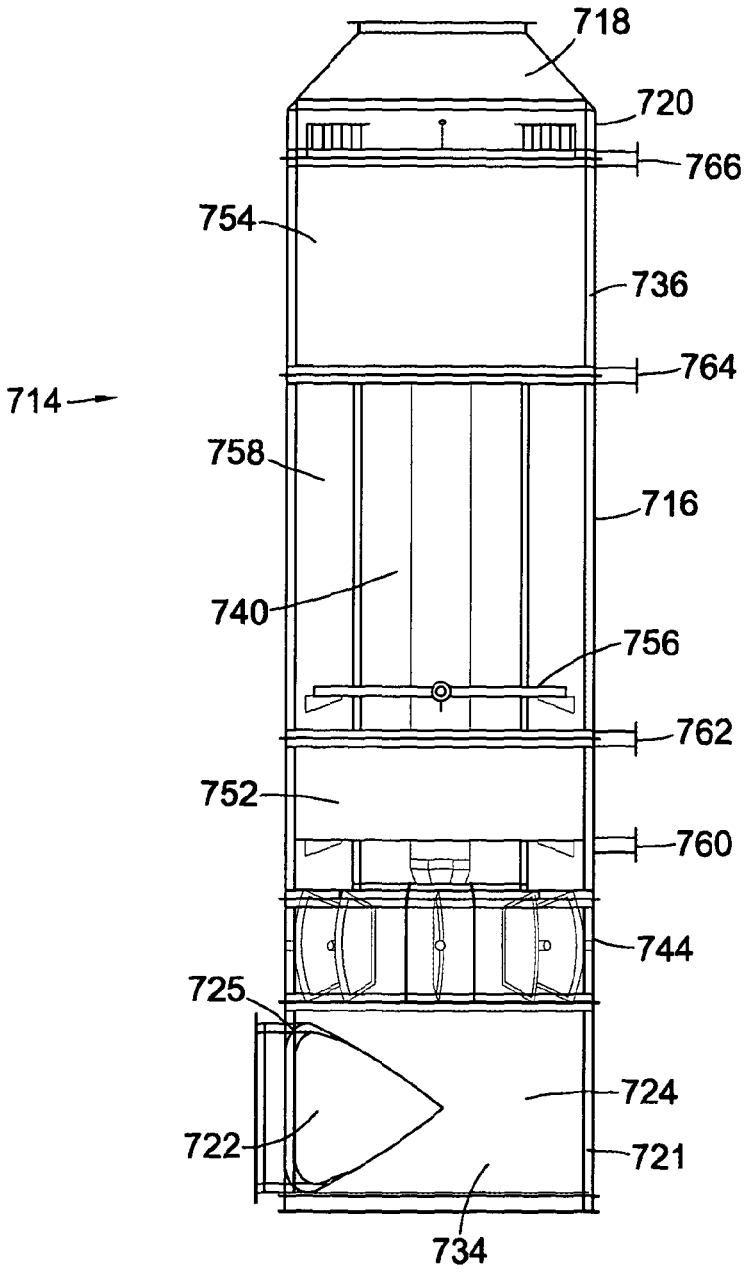
FIG. 7 is a cut-away side view of another embodiment of the invention.
Figure 8:
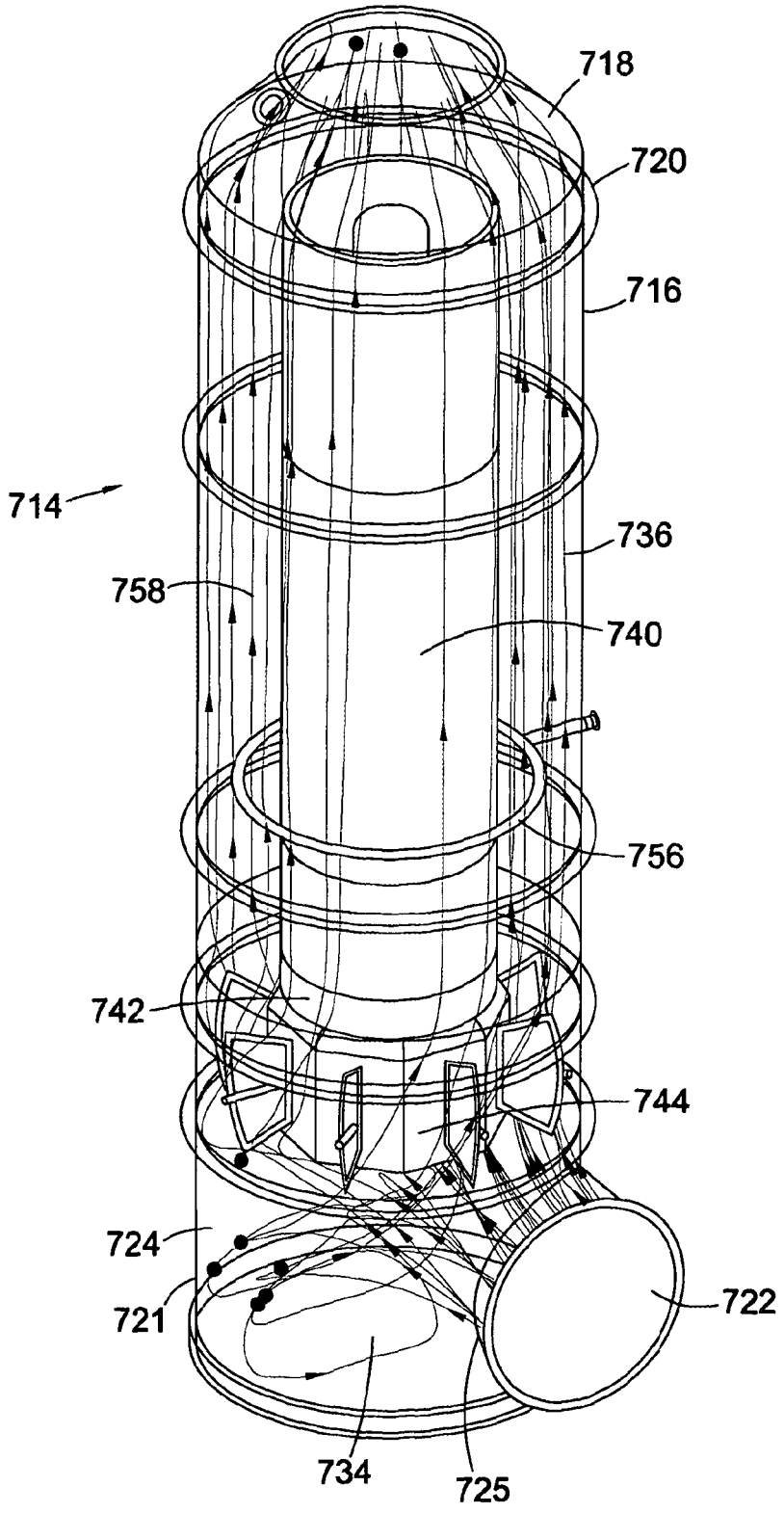
FIG. 8 is a cut-away perspective view of the embodiment of FIG. 7.

Referring now to FIGS. 7 and 8, similar features to those already discussed are given like reference numerals in the series 700. The heat exchange unit 714 shown in FIGS. 7 and 8 is similar to that shown in FIG. 4. It possesses a cylindrical heat exchange duct 716. The heat exchange duct 716 is positioned substantially vertically and is provided with a cone frustum shaped terminus 718 at its distal end region 720 (the end region where exhaust gas exits the heat exchange duct) thereof. At a proximal end region 721 (the end region where exhaust gas enters the heat exchange duct) thereof, the cylindrical heat exchange duct 716 is provided with a gas inlet duct 722. The gas inlet duct 722 and heat exchange duct 716 have substantially perpendicular longitudinal axes and the inlet duct 722 is connected to the heat exchange duct 716 via an aperture 725 in a side wall 724 of the heat exchange duct 716. Additionally the gas inlet duct 722 is positioned so as to introduce the gas tangentially to a portion of the interior perimeter of the side wall 724.

A bypass duct 740 is provided coaxial with and inside the heat exchange duct 716. The bypass duct 740 is cylindrical in shape and is suspended by supports (not shown) above a velocity dissipation chamber 734 defined by the heat exchange duct 716 at its proximal end region 721. The heat exchange duct 716 and bypass duct 740 define a heat exchange chamber 736 between them. First 752 and second 754 heat exchange arrays are positioned in the heat exchange chamber 736 surrounding the bypass duct 740 (omitted in FIG. 8 for clarity). Between the first 752 and second 754 heat exchange arrays is a ring burner 756 and a flame development chamber 758 that forms part of the heat exchange chamber 736. The first heat exchange array has a first inlet 760 and a first outlet 762. The second heat exchange array has a second inlet 764 (supplied from the first outlet 762) and a second outlet 766.

The heat exchange arrays and their inlets 760, 764 and outlets 762, 766 form part of a process fluid heating system. At the base 742 of the bypass duct 740 is a diverter array 744 similar to the diverter array 444 discussed previously.

The FIGS. 7 and 8 embodiment is particularly suitable for heating of process fluids because the heat exchange unit 714 is provided with the bypass duct 740. Therefore the heating process can be controlled. It will be appreciated however that the present embodiment could be used in a steam generating system where for the particular application it is desirable for there to be control over the quantity of steam generated.

The embodiment is also particularly suitable for applications where enhanced heat conversion may be required even at the expense of reduced efficiency. This is in view of the ring burner 756, which may be activated to re-heat exhaust gas in the fire development chamber 758, heat from the exhaust gas having been recovered in the first heat exchange array 752. Heat from the re-heated gas is then recovered in the second heat exchange array 754.

In the present embodiment the first 752 and second 754 heat exchange arrays and the ring burner 756 are arranged to optimise heat conversion given use of stainless steel for lining the heat recovery unit. Stainless steel is typically limited to a firing temperature of 760° C. without the use of considerably more expensive lining materials or water cooling. Thus optimisation may for example be achieved where exhaust gas at approximately 525° C. when entering the gas inlet duct 722, is reduced to 300° C. by the first heat exchange array 752. In this case 300° C. is the approximate minimum temperature at which the oxygen content in the exhaust gas is sufficient to allow combustion at the ring burner 756. The exhaust gas is then heated to approximately 760° C. (the stainless steel firing temperature limit), before its temperature is reduced to approximately 200° C. in the second heat exchange array 754.

It should be noted that use of the ring burner 756 between the first 752 and second 754 heat exchange arrays may only be possible in view of the better flow distribution provided by the velocity dissipation chamber 734 and the coils of the first 752 heat exchange array.

Figure 9:
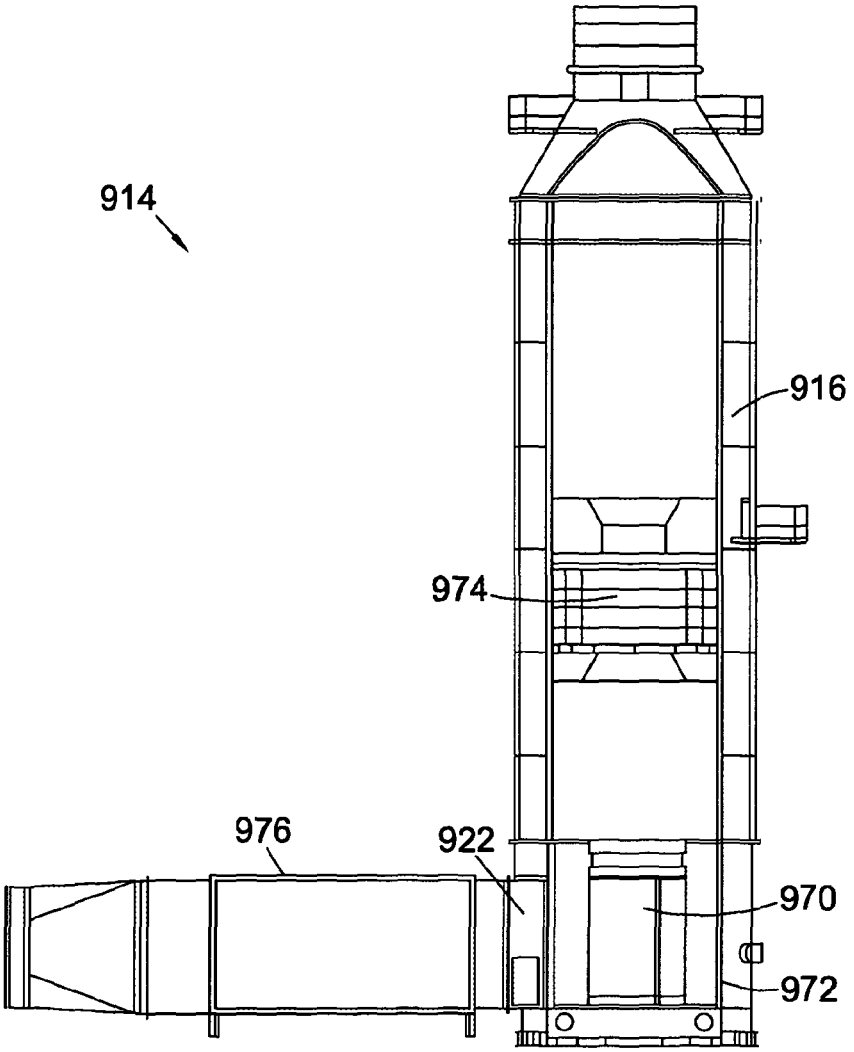
FIG. 9 is a cut-away side view of another embodiment of the invention.

Referring now to FIG. 9 similar features to those already discussed are given like reference numerals in the series 900. The heat exchange unit 914 shown in FIG. 9 is similar to the other embodiments discussed, but illustrates additional features that may be incorporated with those embodiments.

The first feature is a burner (not shown) in a burner duct 976. The burner duct 976 is positioned intermediate a gas inlet duct 922 and a gas turbine (not shown). The burner in the burner duct 976 may be controlled to increase the temperature of the exhaust gas from the gas turbine in order to enhance heat conversion in the heat exchange unit 914.

The second feature is the provision of catalysts in the heat exchange unit 914 for reducing carbon monoxide and nitrogen oxide emissions. The carbon monoxide catalyst 970 is positioned at the base 972 of the heat exchange duct 916. Here the temperatures are high which improves carbon monoxide conversion. The nitrogen oxide catalyst 974 is positioned further up the heat exchange duct where temperatures are lower and better suited to nitrogen oxide conversion. The catalysts 972 and 974 are positioned in areas of the heat exchange duct 916 having large cross-sectional areas so as back pressure created by the catalysts 972 and 974 is less significant.

It will be appreciated that the embodiments described above have a compact design that may be similar in outward appearance and size to a pre-existing exhaust stack in a simple cycle process. It may therefore cause relatively little disruption to replace such an existing exhaust stack with an embodiment of the present invention so as to create a combined cycle process. It may additionally be possible to utilise pre-existing exhaust stack foundations so as to decrease disruption. Further where the inlet duct and heat exchange duct have substantially perpendicular longitudinal axes so as in use gas is delivered to the heat exchange duct in a direction substantially perpendicular to the longitudinal axis of the heat exchange duct, rapid and easy connection of the source of exhaust gas and the inlet duct may be facilitated. The size, shape and design of embodiments of the present invention also lend themselves to pre-assembly and testing. Therefore installation time may be significantly reduced over prior art systems such as that shown in FIG. 1, where on-site assembly and testing would be necessary.

The invention claimed is:

1. A heat exchange unit adapted to be connectable to a gas turbine and arranged to recover energy from exhaust gas of a gas turbine to which the unit is attached, the heat exchange unit comprising:

an inlet duct which in use is in fluid connection with the gas turbine; and a heat exchange duct connected to the inlet duct, wherein the inlet duct and heat exchange duct have substantially perpendicular longitudinal axes so as in use gas is delivered to the heat exchange duct in a direction substantially perpendicular to the longitudinal axis of the heat exchange duct, wherein the inlet duct is arranged to introduce gas tangentially to the interior of the heat exchange duct, and wherein the heat exchange duct comprises:

a velocity dissipation chamber; and a heat exchange chamber arranged around a central duct which is one of a maintenance duct and a bypass duct, wherein exhaust gas is delivered via the inlet duct to a portion of the interior perimeter region of the velocity dissipation chamber where high speed circulating gas currents dissipate their kinetic energy in a controlled manner before moving through the heat exchange duct and over a helical heat exchange array situated within the heat exchange chamber of the heat exchange duct.

2. A heat exchange unit according to claim 1, wherein the heat exchange array is supplemented by at least one additional heat exchange array, both situated within the heat exchange duct and wherein between at least two of the heat exchange arrays is a heating mechanism arranged to heat exhaust gas travelling through the heat exchange duct.

3. A heat exchange unit according to claim 2 wherein the two heat exchange arrays having the heating mechanism therebetween and the heating mechanism are arranged such that exhaust gas travelling through the heat exchange unit falls to a temperature of typically between 250 and 350° C. before reaching the heating mechanism.

4. A heat exchange unit according to claim 2 wherein the heating mechanism is arranged to raise the temperature of the exhaust gas travelling through the heat exchange unit to typically between 700 and 800° C.

5. A heat exchange unit according to claim 4 wherein the heat exchange duct has a stainless steel liner.

6. A heat exchange unit according to claim 2 wherein the heating mechanism is a ring burner.

7. A heat exchange unit according to claim 1, wherein the heat exchange array forms part of a heat exchange system and wherein the heat exchange array surrounds a maintenance duct and wherein the maintenance duct is arranged to allow access for inspection and/or maintenance of at least part of the heat exchange system.

8. A heat exchange unit according to claim 7 wherein the maintenance duct is provided with a vertical access means for passing substantially the full height of the maintenance duct.

9. A heat exchange unit according to claim 7 further comprising at least one of pipes and headers for supply and egress of fluid from the heat exchange array, and wherein the pipes and headers are provided within the maintenance duct and wherein the maintenance duct provides access to the pipes and headers for at least one of inspection and maintenance.

10. A heat exchange unit according to claim 7 wherein the maintenance duct acts as a deflector for gas entering via the gas inlet duct, so as to alter the gas flow distribution.

11. A heat exchange unit according to claim 7 wherein the central duct is substantially cylindrical in cross-section.

12. A heat exchange unit according to claim 7 wherein the maintenance duct provides man access to the interior thereof.

13. A heat exchange unit according to claim 1, wherein the heat exchange unit is a once through steam generator.

14. A heat exchange unit according to claim 1 wherein the heat exchange array comprises a helically wound pipe.

15. A heat exchange unit according to claim 1, where the central duct is a heat exchange duct and is substantially cylindrical.

16. A heat exchange unit arranged to recover energy from exhaust gas, the heat exchange unit comprising an inlet duct to which a heat exchange duct is connected, wherein a heat exchange array is situated within the heat exchange duct and wherein the inlet duct and heat exchange duct have substantially perpendicular longitudinal axes so that in use gas is delivered to the heat exchange duct in a direction substantially perpendicular to the longitudinal axis of the heat exchange duct, wherein the inlet duct is arranged to introduce gas tangentially to the interior of the heat exchange duct and wherein the heat exchange array surrounds a maintenance duct, the maintenance duct being arranged to allow access for inspection and/or maintenance of at least part of the heat exchange system, and at least one of pipes and headers for supply and egress of fluid from the heat exchange array are provided within the maintenance duct and wherein the maintenance duct provides access to the pipes and headers for at least one of inspection and maintenance.

* * * * *